US009222475B2

(12) United States Patent
Kim et al.

(10) Patent No.: US 9,222,475 B2
(45) Date of Patent: Dec. 29, 2015

(54) SCROLL COMPRESSOR WITH BACK PRESSURE DISCHARGE

(71) Applicant: LG ELECTRONICS INC., Seoul (KR)

(72) Inventors: Suchul Kim, Seoul (KR); Honggyun Jin, Seoul (KR); Juhwan Yun, Seoul (KR); Kiwon Park, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 245 days.

(21) Appl. No.: 13/949,412

(22) Filed: Jul. 24, 2013

(65) Prior Publication Data

US 2014/0271306 A1 Sep. 18, 2014

(30) Foreign Application Priority Data

Mar. 18, 2013 (KR) ..... 10-2013-0028791

(51) Int. Cl.

| | |
|---|---|
| ***F04C 18/02*** | (2006.01) |
| ***F04C 27/00*** | (2006.01) |
| ***F04C 28/26*** | (2006.01) |
| ***F04C 23/00*** | (2006.01) |

(52) U.S. Cl.

CPC ..... *F04C 18/0261* (2013.01); *F04C 18/023* (2013.01); *F04C 18/0215* (2013.01); *F04C 23/008* (2013.01); *F04C 27/005* (2013.01); *F04C 28/26* (2013.01)

(58) Field of Classification Search

CPC ..... F04C 18/0215; F04C 18/023; F04C 18/0261; F04C 27/005; F04C 28/26

See application file for complete search history.

(56) References Cited

U.S. PATENT DOCUMENTS

| | | | | |
|---|---|---|---|---|
| 5,102,316 | A | 4/1992 | Caillat et al. | |
| 5,156,539 | A | 10/1992 | Anderson et al. | |
| RE35,216 | E | 4/1996 | Anderson et al. | |
| 5,674,058 | A | 10/1997 | Matsuda et al. | 417/440 |
| 6,544,016 | B2 | 4/2003 | Gennami et al. | |
| 6,592,346 | B2 | 7/2003 | Bushnell | |

(Continued)

FOREIGN PATENT DOCUMENTS

| | | | |
|---|---|---|---|
| JP | 05-10701 | U | 2/1993 |
| JP | 07-158570 | A | 6/1995 |

(Continued)

OTHER PUBLICATIONS

European Search Report dated Jun. 5, 2014 (Application No. 14159390.5).

(Continued)

*Primary Examiner* — Mary A Davis

(74) *Attorney, Agent, or Firm* — Ked & Associates, LLP

(57) ABSTRACT

A scroll compressor having a back pressure discharge is provided. The scroll compressor may include a casing, a discharge cover, a main frame, a first scroll supported by the main frame, and a second scroll forming at least a discharge chamber together with the first scroll. The second scroll may include a discharge opening through which an operation fluid may be discharged. The scroll compressor may also include a back pressure chamber assembly fastened to the second scroll with a Efastener, a back pressure discharge opening that communicates with the back pressure chamber, and a discharge path by which the discharge chamber and the discharge space communicate with each other. The scroll compressor may further include a check valve disposed at the back pressure discharge opening to prevent the operation fluid from being introduced into the back pressure chamber.

49 Claims, 8 Drawing Sheets

(56) References Cited

U.S. PATENT DOCUMENTS

| | | | | |
|---|---|---|---|---|
| 8,037,702 | B2 * | 10/2011 | Sato et al. | 417/44.2 |
| 2005/0265880 | A1 | 12/2005 | Chang et al. | 418/55.5 |
| 2009/0185935 | A1 | 7/2009 | Seibel et al. | 418/55.4 |
| 2010/0254841 | A1 | 10/2010 | Akei et al. | 418/24 |
| 2010/0303659 | A1 | 12/2010 | Stover et al. | 418/24 |
| 2011/0206548 | A1 | 8/2011 | Doepker | |
| 2012/0107163 | A1 | 5/2012 | Monnier et al. | |
| 2014/0134031 | A1 | 5/2014 | Doepker et al. | |
| 2014/0271302 | A1 | 9/2014 | Kim et al. | |
| 2014/0271306 | A1 | 9/2014 | Kim et al. | |

FOREIGN PATENT DOCUMENTS

| | | | |
|---|---|---|---|
| JP | H10-184568 | A | 7/1998 |
| KR | 10-2001-0049691 | | 6/2001 |
| KR | 10-2001-0107309 | A | 12/2001 |
| KR | 10-2006-0096377 | A | 9/2006 |
| KR | 10-0834017 | B1 | 6/2008 |
| KR | 10-2011-0010135 | A | 1/2011 |
| KR | 10-2012-0115581 | | 10/2012 |
| KR | 10-1231059 | B1 | 2/2013 |
| WO | WO 01/34979 | A1 | 5/2001 |

OTHER PUBLICATIONS

European Search Report dated Apr. 28, 2014 issued in Application No. 14 15 9448.

European Search Report dated Apr. 30, 2014 issued in Application No. 14 15 9431.

* cited by examiner

SCROLL COMPRESSOR WITH BACK PRESSURE DISCHARGE

CROSS-REFERENCE TO RELATED APPLICATION(S)

This application claims priority to Korean Application No. 10-2013-0028791, filed in Korea on Mar. 18, 2013, the contents of which is incorporated by reference herein in its entirety.

BACKGROUND

1. Field

A compressor, and more particularly, a scroll compressor is disclosed herein.

2. Background

Scroll compressors are known. However, they suffer from various disadvantages.

A scroll compressor refers to a compressor that utilizes a first or orbital scroll and a second or fixed scroll having a spiral wrap, the first scroll performing an orbital motion with respect to the second scroll. While the first scroll and the second scroll are engaged with each other in operation, a capacity of a pressure chamber formed therebetween may be reduced as the first scroll performs the orbital motion. Hence, the pressure of a fluid in the pressure chamber may be increased, and the fluid discharged from a discharge opening formed at a central portion of the second scroll.

The scroll compressor performs a suction process, a compression process, and a discharge process consecutively while the first scroll performs the orbital motion. Because of operational characteristics, the scroll processor may not require a discharge valve and a suction valve in principle, and its structure may be simple with a small number of components, thus making it possible to perform a high speed rotation. Further, as the change in torque required for compression is small and the suction and compression processes consecutively performed, the scroll compressor is known to create a minimal noise and vibration.

For the scroll compressor, an occurrence of leakage of a refrigerant between the first scroll and the second scroll should be avoided or kept at a minimum, and lubricity (lubrication characteristic) should be enhanced therebetween. In order to prevent a compressed refrigerant from leaking between the first scroll and the second scroll, an end of a wrap portion should be adhered to a surface of a plate portion. On the other hand, in order for the first scroll to smoothly perform an orbital motion with respect to the second scroll, resistance due to friction should be minimized. The relationship between the prevention of the refrigerant leakage and the enhancement of the lubricity is contradictory. That is, if the end of the wrap portion and the surface of the plate portion are adhered to each other with an excessive force, leakage may be prevented. However, in such a case, more friction between the parts may result, thereby increasing noise and abrasion. On the other hand, if the end of the wrap portion and the surface of the plate portion are adhered to each other with less than an adequate sealing force, the friction may be reduced, but the lowering of the sealing force may result in the increase of leakage.

In order to solve such problems, a back pressure chamber having an intermediate pressure between a discharge pressure and a suction pressure may be formed on a rear surface of the first scroll or the second scroll. That is, the first scroll and the second scroll may be adhered to each other with proper force, by forming a back pressure chamber that communicates with a compression chamber having an intermediate pressure, among a plurality of compression chambers formed between the first scroll and the second scroll. With such a configuration, leakage of refrigerant may be prevented and lubricity enhanced.

The back pressure chamber may be positioned on a lower surface of the first scroll or an upper surface of the second scroll. In this case, the scroll compressor with such a back pressure chamber may be referred to as a 'lower back pressure type scroll compressor' or an 'upper back pressure type scroll compressor' for convenience. The structure of the lower back pressure type scroll compressor is simple, and its bypass holes easily formed. However, as its back pressure chamber is positioned on the lower surface of the first scroll, the form and position of the back pressure chamber change due to the orbital motion. This may cause the first scroll to tilt, resulting in the occurrence of vibration and noise. Further, an O-ring to prevent leakage of a compressed refrigerant may be rapidly abraded. The structure of the upper back pressure type scroll compressor is complicated. However, as the back pressure chamber of the upper back pressure type scroll compressor is fixed in form and position, the probability of the second scroll tilting is low, and sealing for the back pressure chamber is excellent.

Korean Patent Application No. 10-2000-0037517, entitled Method for Processing Bearing Housing and Scroll Machine having Bearing Housing, which corresponds to U.S. Pat. No. 5,156,539 and U.S. Reissue Pat. No. 35,216, all of which are hereby incorporated by reference, discloses an example of such an upper back pressure type scroll compressor. FIG. 1 is a partial cross-sectional view showing an example of an upper back pressure type scroll compressor. The scroll compressor 1 of FIG. 1 may include a first or orbital scroll 30 configured to perform an orbital motion on a main frame 20 fixedly-installed in a casing 10 and a second or fixed scroll 40 engaged with the first scroll 30 to create a plurality of compression chambers upon the orbital motion. A back pressure chamber BP may be formed at an upper portion of the second scroll 40, and a floating plate 60 to seal the back pressure chamber BP may be installed so as to be slidable up and down along an outer circumferential surface of a discharge passage 45. A discharge cover 2 may be installed on an upper surface of the floating plate 60, thereby dividing an inner space of the scroll compressor 1 into a suction space (S) and a discharge space (D). A lip seal (not shown) may be installed between the floating plate 60 and the back pressure chamber BP, so that refrigerant may be prevented from leaking from the back pressure chamber BP.

The back pressure chamber BP may communicate with one of the plurality of compression chambers, and may be at the receiving end of an intermediate pressure from the plurality of compression chambers. With such a configuration, pressure may be applied upward to the floating plate 60, and the pressure also applied downward to the second scroll 40. If the floating plate 60 moves upward due to pressure of the back pressure chamber BP, the discharge space may be sealed as an end of the floating plate 60 contacts the discharge cover 2. In this case, the second scroll 40 may move downward to be adhered to the first scroll 30. With such a configuration, a gap between the second scroll 40 and the first scroll 30 may be effectively sealed.

The pressure inside the back pressure chamber BP should be maintained at a level that enhances the sealing of the leakage while minimizing the friction between components. However, in a case in which the pressure inside the back pressure chamber BP is higher than a discharge pressure due to change in an operating condition of the scroll compressor, or in a case in which the pressure inside the back pressure chamber BP is drastically increased when the compressor is initially operated, the refrigerant inside the back pressure chamber may excessively press the second scroll, thus resulting in noise and abrasion due to friction between the components. In this case, the refrigerant should be discharged outside so as to reduce the pressure inside the back pressure chamber BP. In the conventional art, the refrigerant inside the back pressure chamber is discharged to the discharge space through a lip seal.

However, when the scroll compressor having such configuration is applied to an air conditioner for both heating and cooling, there occur problems. More specifically, during a heating operation, when a defrosting process should be performed to defrost a condenser of an outdoor unit or device, or when the heating operation is converted into a cooling operation, a size of the suction pressure and a size of the discharge pressure of the scroll compressor are reversed from their normal configuration. That is, right after the change in the operation mode, the suction pressure becomes higher than the discharge pressure.

As the pressure inside the back pressure chamber becomes higher than the discharge pressure, the refrigerant inside the back pressure chamber is rapidly discharged through an entire inner circumferential surface of the lip seal, until the pressure inside the back pressure chamber becomes equal to the discharge pressure. As an upper surface of the floating plate is disposed in the suction space, an upper pressure of the floating plate becomes higher than the pressure inside the back pressure chamber. At the same time, the floating plate moves downward, while the second scroll moves upward by a suction pressure. That is, as the gap between the second scroll and the first scroll is widened due to the anomaly of the sucking pressure and the discharge pressure, the first scroll tilts during its operation, thus resulting in noise and vibration. In order to solve such problems, U.S. Patent Pub. No. 2012/0107163, which is hereby incorporated by reference, discloses a compressor seal assembly in which a hole is formed at one side of the back pressure chamber to communicate the back pressure chamber with the suction space, and an Injection Pressure Regulator (IPR) valve formed of springs and balls is installed at or in the hole. With such a configuration, in a case in which the pressure inside the back pressure chamber is higher than the pressure of the suction space by a predetermined amount, the refrigerant inside the back pressure chamber is discharged to the suction side. Therefore, in a case in which the pressure inside the back pressure chamber is excessively high, the pressure inside the back pressure chamber may be reduced using the valve.

BRIEF DESCRIPTION OF THE DRAWINGS

Embodiments will be described in detail with reference to the following drawings in which like reference numerals refer to like elements, and wherein.

DETAILED DESCRIPTION

Figure 1:
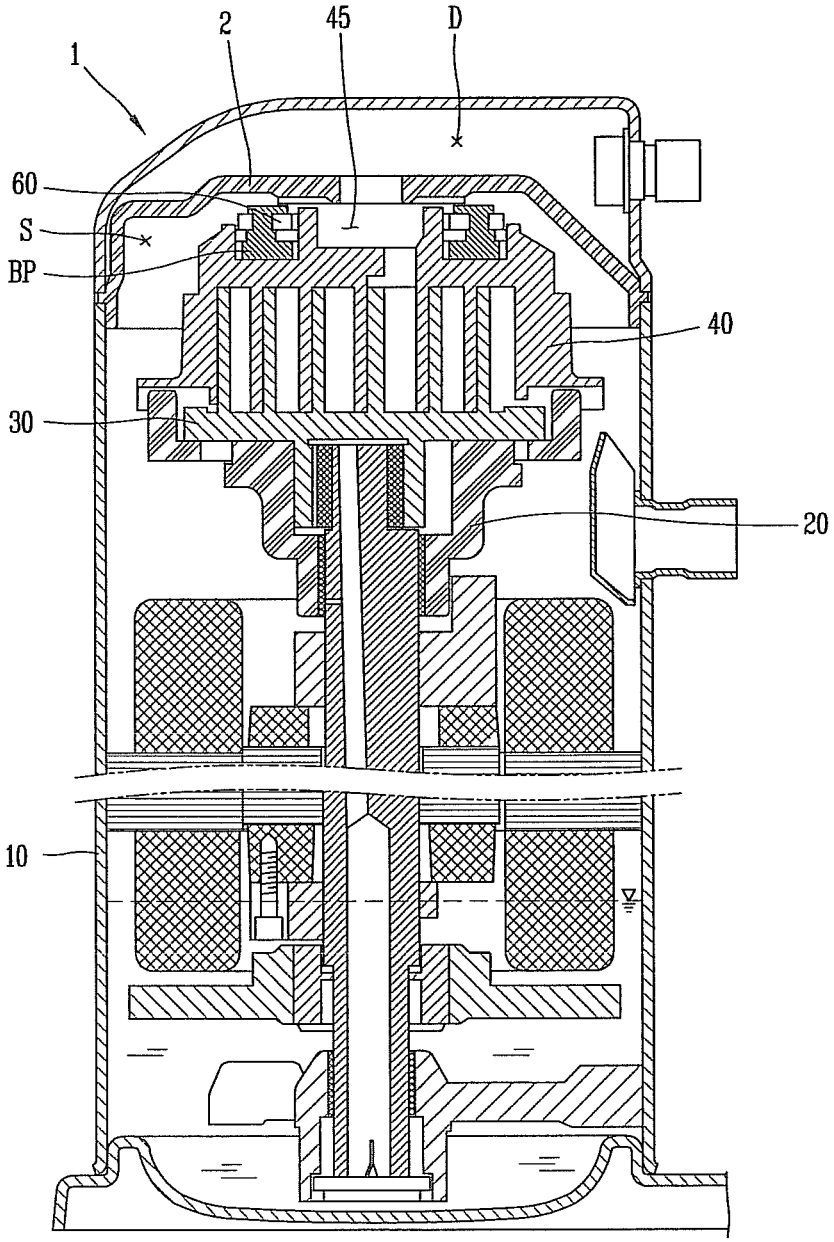
FIG. 1 is a partial cross-sectional view showing an example of an upper back pressure type scroll compressor.

Description will now be given in detail of embodiments, with reference to the accompanying drawings. Where possible, like reference numerals have been utilized to indicate like elements, and repetitive disclosure has been omitted.

As discussed above, as the suction pressure is lower than the pressure inside the back pressure chamber in a normal operating condition, a general check valve may not be used. Rather, a specific IPR valve configured to open only when a pressure difference between the suction pressure and the pressure inside the back pressure chamber has a predetermined value should be used. If the specification or operating condition of the scroll compressor changes, the IPR valve should be adjusted or reconfigured accordingly. This may cause a difficulty in designing the scroll compressor and an increase in the cost of the scroll compressor.

Therefore, embodiments disclosed herein provide a scroll compressor having a back pressure discharge capable of stably controlling pressure inside a back pressure chamber despite a change in operating condition of the scroll compressor.

Figure 2:
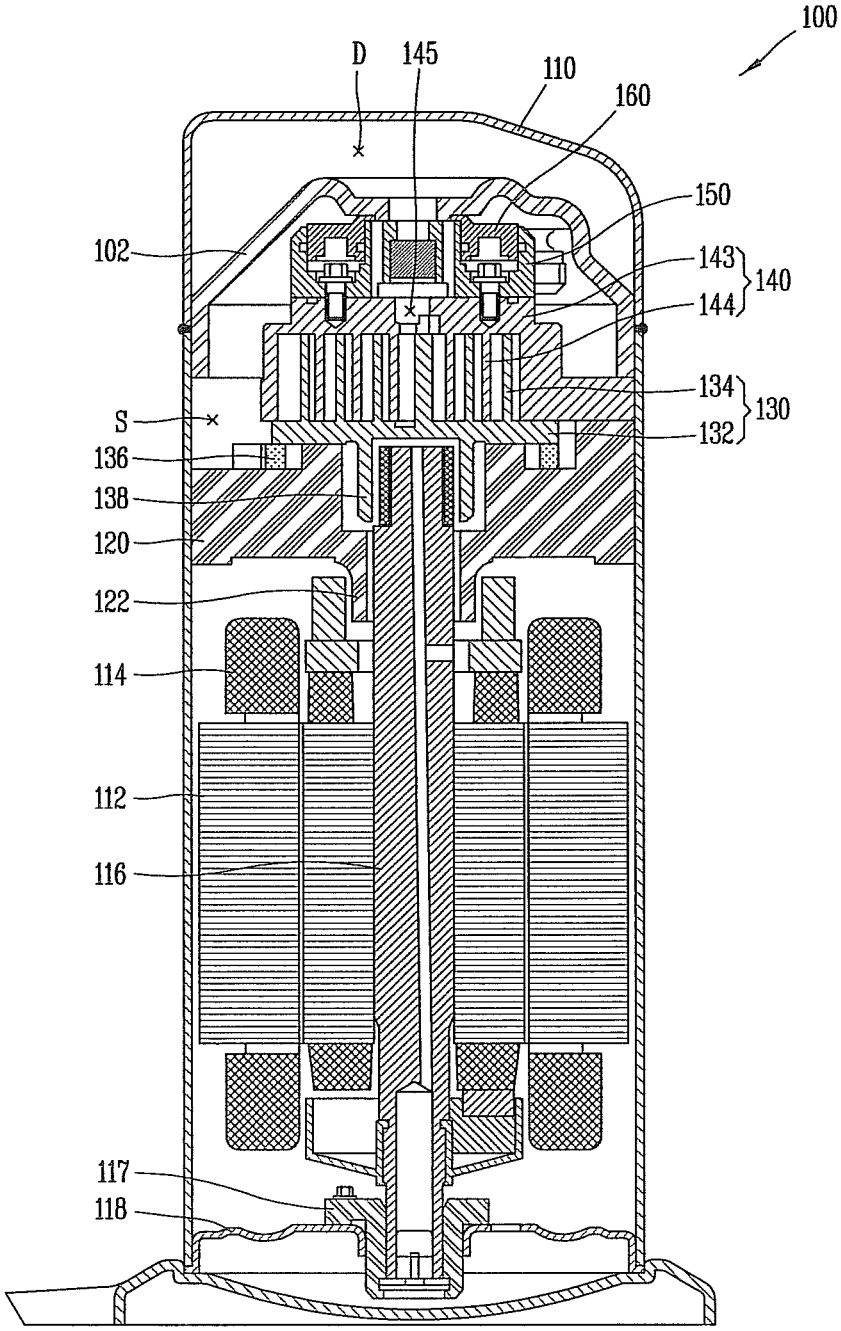
FIG. 2 is a cross-sectional view showing a scroll compressor having a back pressure discharge according to an embodiment.
Figure 3:
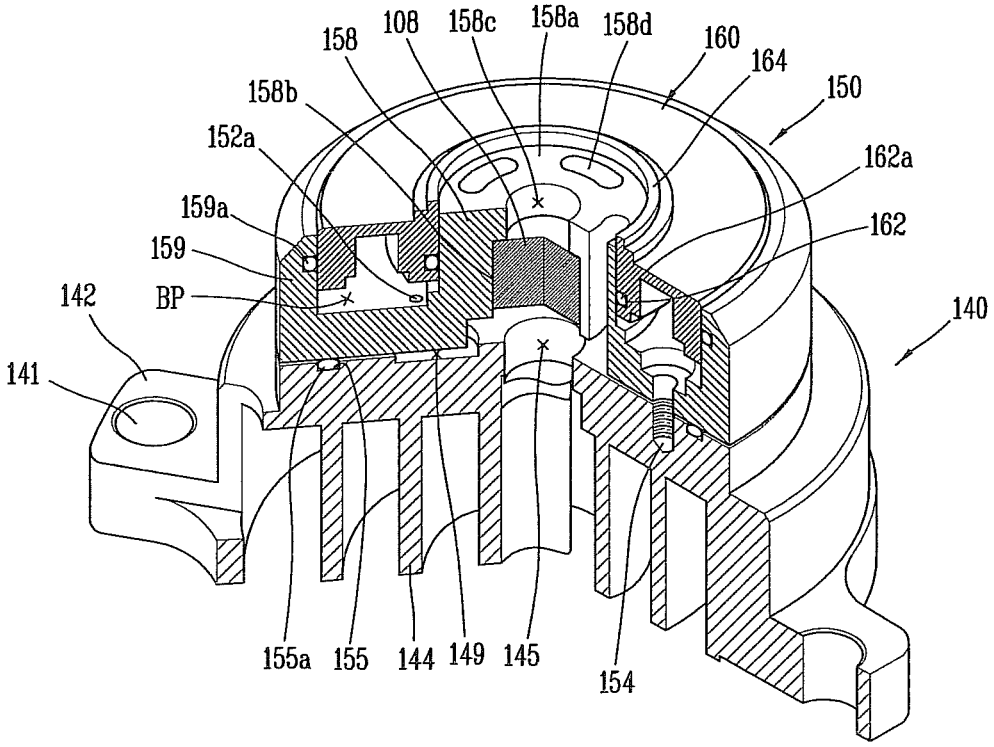
FIG. 3 is a perspective view showing a coupled state between a second scroll and a back pressure chamber assembly of FIG. 2.
Figure 4:
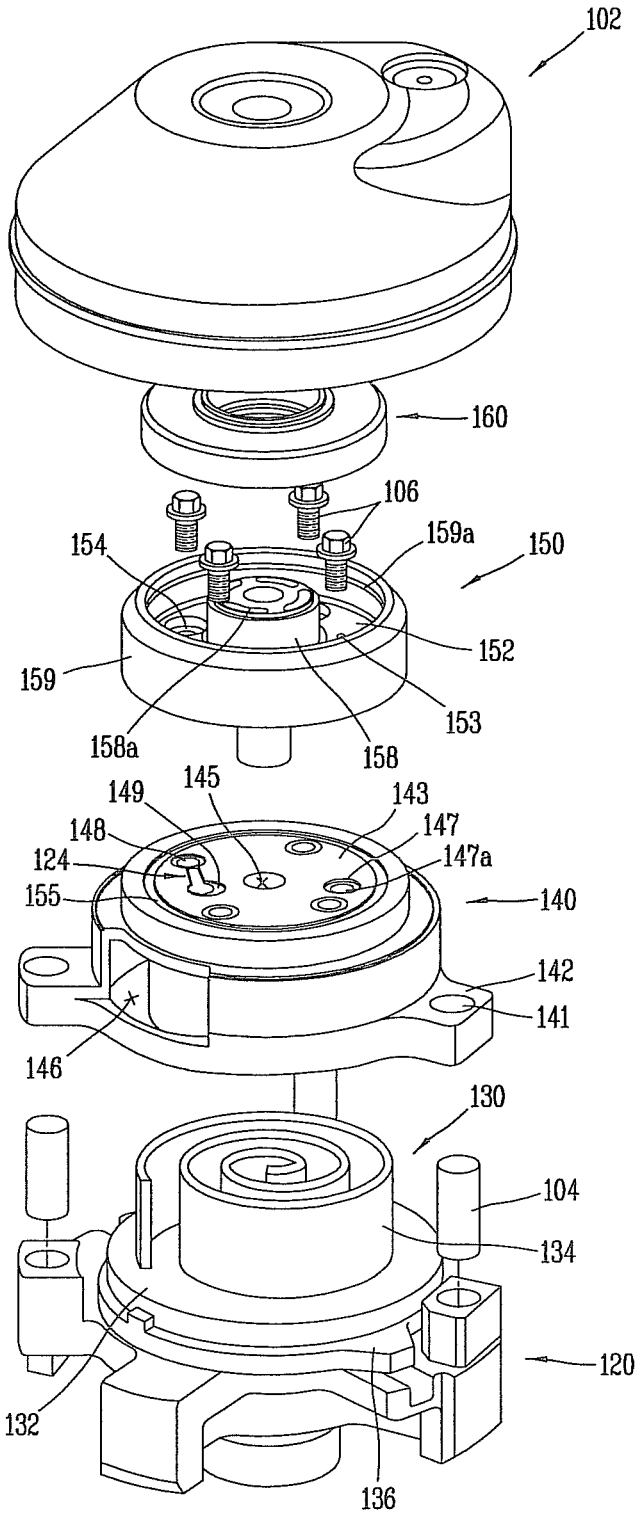
FIG. 4 is an exploded perspective view of the second scroll and the back pressure chamber assembly of FIG. 2.

FIG. 2 is a cross-sectional view showing a scroll compressor having a back pressure discharge according to an embodiment, FIG. 3 is a perspective view showing a coupled state between a second scroll and a back pressure chamber assembly of FIG. 2. FIG. 4 is an exploded perspective view of the second scroll and the back pressure chamber assembly of FIG. 2.

Referring to FIG. 2, a scroll compressor 100 having a back pressure discharge according to an embodiment may include a casing 110 having a suction space (S) and a discharge space (D), which are discussed hereinbelow. An inner space of the casing 110 may be divided into the suction space (S) and the discharge space (D) by a discharge cover 102 installed at an upper portion of the casing 110. A space above the discharge cover 102 may correspond to the discharge space (D), and a space below the discharge cover 102 may correspond to the suction space (S). A suction port (not shown) that communicates with the suction space (S) and a discharge port (not shown) that communicates with the discharge space (D) may be fixed to the casing 110, through which a refrigerant may be sucked into the casing 110 and discharged outside of the casing 110, respectively.

A stator 112 and a rotor 114 may be provided below the suction space (S). The stator 112 may be fixed to an inner wall surface of the casing 110, for example, in a shrinkage fitting manner. A rotational shaft 116 may be inserted into a central portion of the rotor 114, and may be rotated by power supplied from outside.

A lower side of the rotational shaft 116 may be rotatably supported by an auxiliary bearing 117 installed at a lower portion of the casing 110. The auxiliary bearing 117 may be supported by a lower frame 118 fixed to an inner surface of the casing 110, thereby stably supporting the rotational shaft 116. The lower frame 118 may be fixed to an inner wall surface of the casing 110, for example, by welding, and a lower surface of the casing 110 may be used as an oil storage space. Oil stored in the oil storage space may be transferred upward by the rotational shaft 116, so that the oil may be uniformly supplied into the casing 110.

An upper end of the rotational shaft 116 may be rotatably supported by a main frame 120. The main frame 120 may be fixed to an inner wall surface of the casing 110, similar to the lower frame 118. A main bearing 122 that protrudes downward may be formed on a lower surface of the main frame 120, and the rotational shaft 116 may be inserted into the main bearing 122. An inner wall surface of the main bearing 122 may serve as a bearing surface and support the rotational shaft 116 together with the aforementioned oil, so that the rotational shaft 116 may rotate in a smooth manner.

A first or orbital scroll 130 may be disposed on an upper surface of the main frame 120. The first scroll 130 may include a plate portion 132, which may have an approximate disc shape, and a wrap 134 spirally formed on one side surface of the plate portion 132. The wrap 134 may form a plurality of compression chambers together with a wrap 144 of a second or fixed scroll 140, which is discussed hereinbelow. The plate portion 132 of the first scroll 130 may perform an orbital motion while being supported by an upper surface of the main frame 120. An Oldham ring 136 may be installed between the plate portion 132 and the main frame 120, and prevent rotation of the first scroll 130. A boss portion 138, in which the rotational shaft 116 may be inserted, may be formed on a lower surface of the plate portion 132 of the first scroll 130, thus allowing the first scroll 130 to perform an orbital motion by a rotation force of the rotational shaft 116.

The second scroll 140, which may engage the first scroll 130, may be disposed above the first scroll 130. The second scroll 140 may be installed to be movable up and down with respect to the first scroll 130. More specifically, the second scroll 140 may be disposed on an upper surface of the main frame 120 using, for example, a fastener, for example, three guide pins 104, fitted into the main frame 120 inserted into three guide holes 141 formed on an outer circumference of the second scroll 140.

The guide holes 141 may be formed at three pin supporting portions 142 that protrude from an outer circumferential surface of a body portion of the second scroll 140. The number of the guide pins 104 or pin supporting portions 142 may be arbitrarily set, and thus, the number is not limited to three.

The second scroll 140 may include a plate portion 143, which may have a disc shape. The wrap 144, which may engage the wrap 134 of the first scroll 130, may be formed below the plate portion 143. The wrap 144 may have a spiral shape, and a discharge opening 145, through which a compressed refrigerant may be discharged, may be formed at a central portion of the plate portion 143. A suction opening 146, through which refrigerant disposed in the suction space (S) may be sucked, may be formed on a side surface of the second scroll 140 so that the refrigerant may be sucked to the suction opening 146 by an interaction between the wrap 144 and the wrap 134.

As discussed above, the wrap 144 and the wrap 134 may form a plurality of compression chambers. As the plurality of compression chambers decrease in volume while orbiting toward the discharge opening 145, a refrigerant may be compressed. As a result, a pressure of a compression chamber adjacent to the suction opening 146 may be minimized, and a pressure of a compression chamber that communicates with the discharge opening 145 may be maximized. A pressure of a compression chamber positioned between the above-mentioned two compression chambers may be called an intermediate pressure and may be halfway between a suction pressure at the suction opening 146 and a discharge pressure at the discharge opening 145. The intermediate pressure may be applied to a back pressure chamber (BP), which is discussed hereinbelow, and may press the second scroll 140 toward the first scroll 130. Therefore, an intermediate pressure discharge opening 147, which may communicate with one of the intermediate pressure chambers and through which refrigerant may be discharged, may be formed at the plate portion 143, referring to FIG. 4.

An intermediate pressure sealing groove 147*a*, in which an intermediate pressure O-ring 147*b* that prevents leakage of a discharged refrigerant having the intermediate pressure may be inserted, may be formed near the intermediate pressure discharge opening 147. The intermediate pressure sealing groove 147*a* may be formed in an approximately circular shape to enclose the intermediate pressure discharge opening 147. However, the shape is not limited to a circular shape. Further, the intermediate pressure sealing groove 147*a* may be formed at other than the plate portion 143 of the second scroll 140. For instance, the intermediate pressure sealing groove 147*a* may be formed on a lower surface of a back pressure plate 150, which is discussed hereinbelow.

Bolt coupling holes 148 to receive coupling bolts 106, which function to couple the back pressure plate 150 and the second scroll 140, may be formed at or in the plate portion 143 of the second scroll 140. In this embodiment, the number of the bolt coupling holes 148 is four (4); however, embodiments are not so limited.

Figure 5:
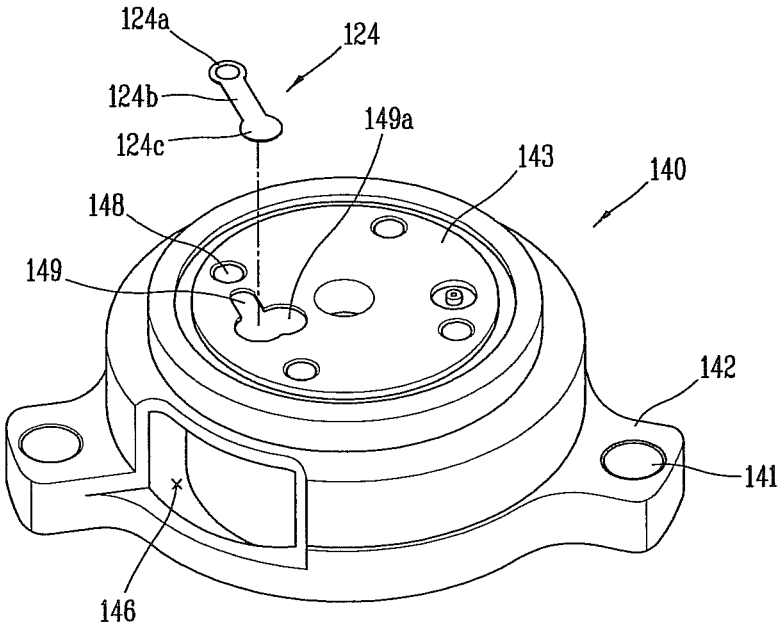
FIG. 5 is a perspective view of the second scroll of FIG. 2.

A valve space portion 149 to provide an operation space for a check valve 124, which is discussed hereinbelow, may be formed at the plate portion 143. The valve space portion 149 may be concave from a surface of the plate portion 143, thereby providing a space in which a valve supporting portion of the check valve 124, which may be implemented as a reed valve, may move up or down. Referring to FIG. 5, the valve space portion 149 may be disposed in a lengthwise direction of the check valve 124, and extend between two bolt coupling holes 148.

The plate portion 143 may be provided with a path forming portion 149*a* connected to the valve space portion 149, the path forming portion 149*a* extending in a radial direction toward the discharge opening 145 of the plate portion 143. The path forming portion 149*a* may be connected to the valve space portion 149. Check valve 124 may be formed on an upper surface of the valve space portion 149. As shown in FIGS. 4 and 5, the check valve 124 may be a reed valve formed of a thin plate. At one side of the check valve 124, a valve supporting portion 124*a* may be disposed at a periphery of the bolt coupling holes 148 and coupled to the plate portion 143 of the second scroll 140 by the bolts 106. At another side of the check valve 124, a valve body 124*c* to open and close a back pressure discharge opening, which is discussed hereinbelow, may be formed. The valve supporting portion 124*a* and the valve body 124*c* may be connected to each other by a connection portion 124*b*. The valve space portion 149 may be positioned below the connection portion 124*b*, and provide a space where the valve body 124*c* and the connection portion 124*b* may be moved in a direction to contact a bottom surface of the path forming portion 149*a*.

Figure 8:
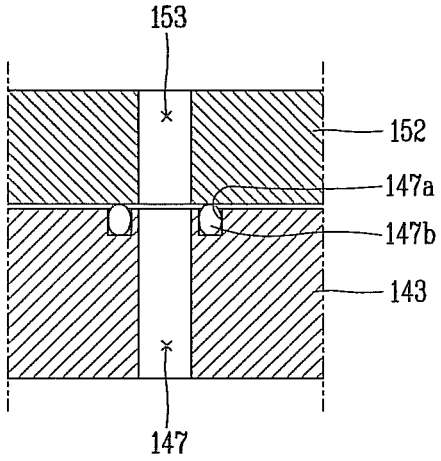
FIG. 8 is a sectional view showing the second scroll and the back pressure plate of FIG. 2 in an enlarged manner.

A back pressure chamber assembly may be installed on the plate portion 143 of the second scroll 140. The back pressure chamber assembly may include the back pressure plate 150 and a floating plate 160, and may be fixed on the plate portion 143 of the second scroll 140. The back pressure plate 150 may have a ring shape, and may include a supporting plate 152 that contacts the plate portion 143 of the second scroll 140. The supporting plate 152 may have a ring shape, and may be formed to allow an intermediate pressure suction opening 153, which may communicate with the aforementioned intermediate pressure discharge opening 147, to pass therethrough, referring to FIG. 8. Further, bolt coupling holes 154, which may communicate with the bolt coupling holes 148 of the plate portion 143 of the second scroll 140, may be formed at or in the supporting plate 152.

Besides the intermediate pressure suction opening 153, a back pressure discharge opening 152*a* may be formed on the supporting plate 152. The back pressure discharge opening 152*a* may be positioned on an opposite side to the intermediate pressure suction opening 153, with respect to a central portion of the supporting plate 152. The back pressure discharge opening 152*a* may be penetratingly-formed at or in the supporting plate 152, so that refrigerant inside a back pressure chamber (BP) formed by the back pressure plate 150 and the floating plate 160 may be discharged to outside of the back pressure chamber assembly.

Figure 6:
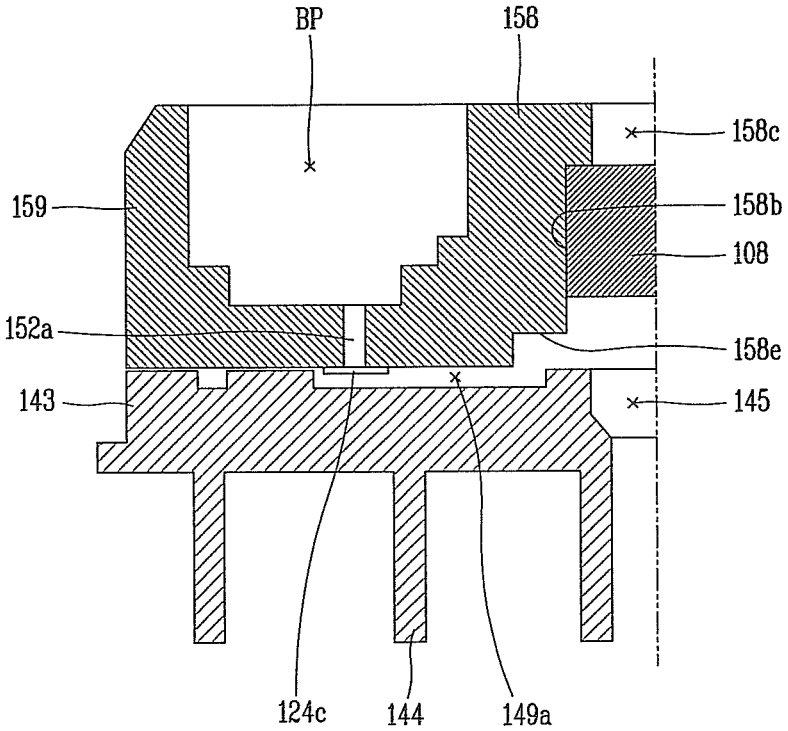
FIG. 6 is a sectional view showing a portion of the second scroll and a back pressure plate in an enlarged manner.

Referring to FIG. 6, the path forming portion 149*a* may be disposed so that one end thereof may be positioned outside the back pressure discharge opening 152*a* in a radial direction, and another end thereof may communicate with a space above the discharge opening 145. The space above the discharge opening 145 may form part of a discharge path along which a discharged operation fluid may move to the discharge space.

Refrigerant inside the back pressure chamber BP may apply pressure to the valve body 124*c* through the back pressure discharge opening 152*a*. In a case in which the pressure of the refrigerant inside the back pressure chamber (BP) is higher than the pressure of the refrigerant inside the discharge opening 145, the refrigerant inside the back pressure chamber BP may be discharged into the path forming portion 149*a* while downward pushing the valve body 124*c*. The discharged refrigerant may move along the path forming portion 149*a*, and then be introduced into the space above the discharge opening 145.

Figure 7:
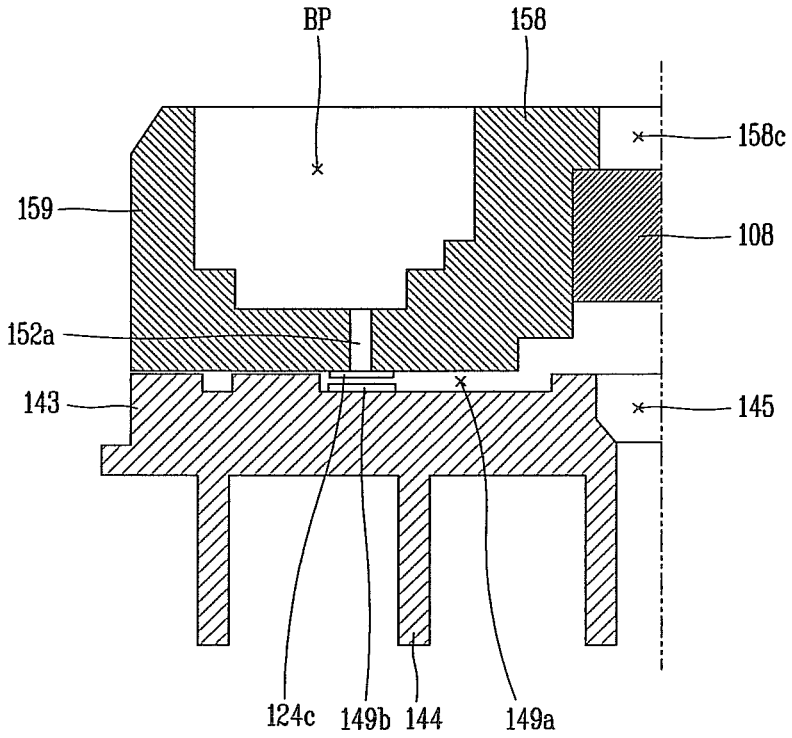
FIG. 7 is a sectional view showing a second scroll and a back pressure plate in an enlarged manner according to another embodiment.

The movement of the valve body 124*c* may be restricted by an upper surface of the path forming portion 149*a*. Therefore, the path forming portion 149*a* may serve as a retainer to restrict and/or guide movement of the valve body 124*c*. As shown in FIG. 7, an additional retainer 149*b* may be installed in the path forming portion 149*a*.

The valve space portion 149 and the path forming portion 149*a* may be formed on an upper surface of the second scroll 140. However, embodiments are not so limited. That is, the valve space portion 149 and the path forming portion 149*a* may be formed on a lower surface of the supporting plate 152.

An O-ring 155*a* may be disposed between a lower surface of the supporting plate 152 and an upper surface of the second scroll 140. The O-ring 155*a*, which may prevent a refrigerant from leaking from a gap between the supporting plate 152 and the fixed scroll 140, may be fitted into a ring-shaped groove 155 formed on an upper surface of the second scroll 140. Further, the O-ring 155*a* may be forcibly pressed while the second scroll 140 and the back pressure plate 150 are coupled to each other by the bolts 106, thereby performing a sealing function between the second scroll 140 and the back pressure plate 150. Alternatively, the ring-shaped groove 155 may be formed on a lower surface of the supporting plate 152, rather than on the second scroll 140.

The back pressure plate 150 may include a first ring-shaped wall 158 and a second ring-shaped wall 159 formed to enclose an inner circumferential surface and an outer circumferential surface of the supporting plate 152, respectively. The first ring-shaped wall 158 and the second ring-shaped wall 159 may form a space having a specific shape together with the supporting plate 152. The space may implement the aforementioned back pressure chamber (BP). The first ring-shaped wall 158 may extend upward from a central portion of the supporting plate 152, and an upper surface 158*a* may cover an upper end of the first ring-shaped wall 158. The first ring-shaped wall 158 may have of a cylindrical shape having one open side.

Figure 9:
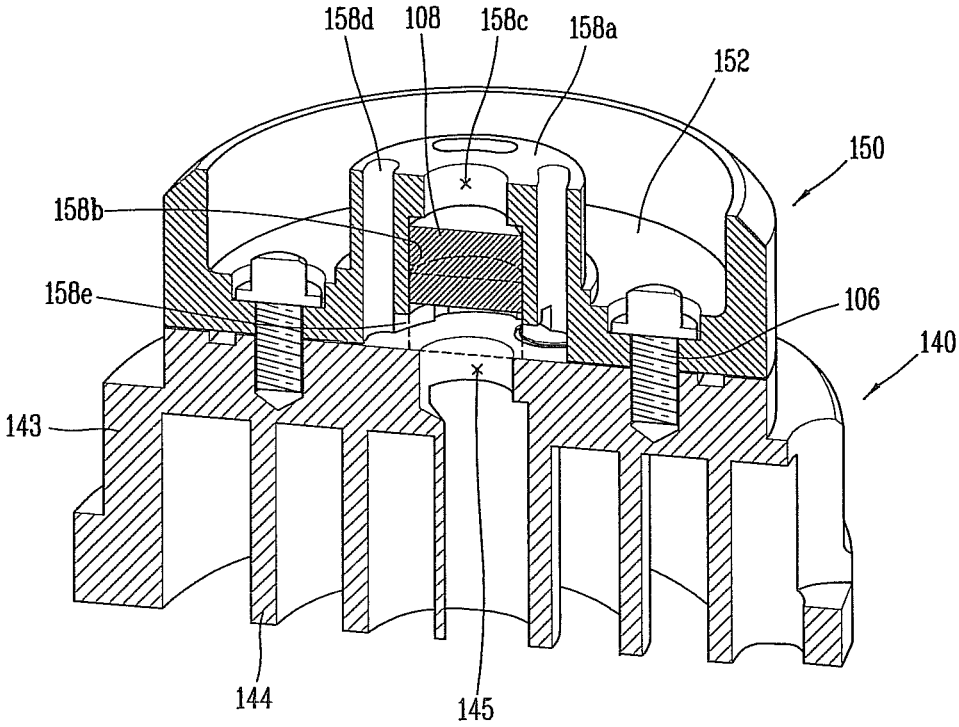
FIG. 9 is a sectional view for explaining operation of a check valve and a discharge check valve of FIG. 2.

An inner space of the first ring-shaped wall 158 may communicate with the discharge opening 145, thereby implementing a portion of a discharge path along which a discharged refrigerant may be transferred to the discharge space (D). Referring to FIGS. 3 and 9, a discharge check valve 108, which may have a cylindrical shape, may be disposed above the discharge opening 145. More specifically, the discharge check valve 108 may have a lower end large enough to completely cover the discharge opening 145. With such a configuration, in a case in which the discharge check valve 108 contacts the plate portion 143 of the second scroll 140, the discharge check valve 108 may block the discharge opening 145.

The discharge check valve 108 may be installed in a valve guide portion 158*b* formed at an inner space of the first ring-shaped wall 158. The valve guide portion 158*b* may guide an up-and-down motion of the discharge check valve 108. The valve guide portion 158*b* may be formed to pass through the inner space of the first ring-shaped wall 158. An inner diameter of the valve guide portion 158*b* may be the same as an outer diameter of the discharge check valve 108, to guide up-and-down motion of the discharge check valve 108 above the discharge opening 145. Alternatively, the inner diameter of the valve guide portion 158*b* may not be completely equal to the outer diameter of the discharge check valve 108, such that there is a space, allowance, or tolerance large enough for the discharge check valve 108 to move.

A discharge pressure applying hole 158*c* that communicates with the valve guide portion 158*b* may be formed at a central portion of an upper surface of the first ring-shaped wall 158. The discharge pressure applying hole 158*c* may communicate with the discharge space (D). Accordingly, in a case in which a refrigerant from the discharge space (D) backflows to the discharge opening 145, a pressure applied to the discharge pressure applying hole 158*c* may be higher than a pressure of the discharge opening 145. As a result, the discharge check valve 108 may move downward to block the discharge opening 145. If the pressure of the discharge opening 145 increases to be higher than the pressure of the discharge space (D), the discharge check valve 108 may move upward to open the discharge opening 145.

One or more intermediate discharge opening(s) 158*d* may be formed outside of the valve guide portion 158*b*. The one or more intermediate discharge opening(s) 158*d* may provide a path through which a refrigerant discharged from the discharge opening 145 may move to the discharge space (D). In this embodiment, four (4) intermediate discharge openings 158*d* are radially disposed; however, the number of the intermediate discharge openings 158*d* may vary. The one or more intermediate discharge opening(s) 158*d* may extend upward from the space portion of the back pressure plate 150, so as to pass through the first ring-shaped wall 158. The one or more intermediate discharge openings 158*d* and the valve guide portion 158*b* may communicate with each other at lower ends thereof. That is, a stepped portion 158*e* may be formed in a connection portion between the first ring-shaped wall 158 and the supporting plate 152. A discharged refrigerant may reach a space defined by the stepped portion 158*e*, and then move to the intermediate discharge opening 158*d*. The stepped portion 158*e* may also serve to communicate the path forming portion 149*a* and the discharge path with each other, so that the discharged refrigerant inside the back pressure chamber BP may be discharged to the discharge space (D) after moving through the discharge path.

In some embodiments, the stepped portion 158*e* may not be omitted, but rather, a communication hole by which the valve guide portion 158*b* and the intermediate discharge opening(s) 158*d* may communicate with each other, may be provided. In any cases, a refrigerant having passed through the discharge opening 145 may not be discharged to the one or more intermediate discharge opening(s) 158*d* when the discharge check valve 108 is closed. Alternatively, the stepped portion 158*e* may be formed at or in the plate portion 143 of the second scroll 140, rather than on the back pressure plate 150.

The second ring-shaped wall 159 may be spaced from the first ring-shaped wall 158 by a predetermined distance, and a first sealing insertion groove 159*a* may be formed on an inner circumferential surface of the second ring-shaped wall 159. The first sealing insertion groove 159*a* may serve to receive and fix an O-ring 159*b*, to prevent leakage of a refrigerant from a contact surface with the floating plate 160, which is discussed hereinbelow. Alternatively, the first sealing insertion groove 159*a* may be formed on an outer circumferential surface of the floating plate 160. However, the first sealing insertion groove 159*a* formed at the floating plate 160 may be less stable than the first sealing insertion groove 159*a* formed at the back pressure plate 150 because the floating plate 160 continuously moves up and down.

A space having an approximately 'U'-shaped section may be formed by the first ring-shaped wall 158, the second ring-shaped wall 159, and the supporting plate 152. The floating plate 160 may be installed to cover the space. The floating plate 160 may have a ring shape, and may be configured so that an inner circumferential surface thereof may face an outer circumferential surface of the first ring-shaped wall 158, and an outer circumferential surface thereof may face an inner circumferential surface of the second ring-shaped wall 159. With such a configuration, the back pressure chamber (BP) may be implemented, and the aforementioned O-ring 159*b* and an O-ring 162*a* may be interposed between respective facing surfaces to prevent a refrigerant inside the back pressure chamber (BP) from leaking to outside.

A second sealing insertion groove 162 to fix the O-ring 162*a* may be formed on the inner circumferential surface of the floating plate 160. The second sealing insertion groove 162 may be inserted into the inner circumferential surface of the floating plate 160, whereas the first sealing insertion groove 159*a* may be formed at or in the second ring-shaped wall 159. The reason is because the first ring-shaped wall 158 has an insufficient margin to process the grooves due to the valve guide portion 158*b* and the one or more intermediate discharge opening(s) 158*d* formed therein, and the first ring-shaped wall 158 may have a smaller diameter than the second ring-shaped wall 159. Alternatively, if the first ring-shaped wall 158 has a large diameter and a sufficient margin to process the grooves, the second sealing insertion groove 162 may be formed at or in the first ring-shaped wall 158.

A sealing end 164 may be provided at an upper end of the space enclosed by the floating plate 160. The sealing end 164 may protrude upward from the surface of the floating plate 160, and have an inner diameter large enough not to cover the one or more intermediate discharge opening(s) 158*d*. The sealing end 164 may contact a lower side surface of the discharge cover 102, thereby sealing the discharge path so that a discharged refrigerant may be discharged to the discharge space (D) without leaking to the suction space (S).

Hereinafter, an operation of a scroll compressor according to an embodiment will be discussed hereinbelow.

When power is supplied to the stator 112, the rotational shaft 116 may rotate. As the rotational shaft 116 rotates, the first scroll 130 fixed to the upper end of the rotational shaft 116 may perform an orbital motion with respect to the second scroll 140. As a result, the plurality of compression chambers formed between the wrap 144 and the wrap 134 move toward the discharge opening 145, thereby compressing the refrigerant.

If the plurality of compression chambers communicate with the intermediate pressure discharge opening 147 before the refrigerant reaches the discharge opening 145, a portion of the refrigerant may be introduced into the intermediate pressure suction opening 153 of the supporting plate 152. Accordingly, an intermediate pressure may be applied to the back pressure chamber (BP) formed by the back pressure plate 150 and the floating plate 160. As a result, pressure may be applied downward to the back pressure plate 150, and pressure may be applied upward to the floating plate 160.

As the back pressure plate 150 may be coupled to the second scroll 140 by, for example, bolts, an intermediate pressure of the back pressure chamber (BP) may also influence the second scroll 140. The floating plate 160 may move upward because the second scroll 140 may not move downward due to contact with the plate portion 132 of the first scroll 130. As the sealing end 164 contacts the lower end of the discharge cover 102, the movement of the floating plate 160 may be stopped. Then, as the second scroll 140 is pushed toward the first scroll 130 by pressure of the back pressure chamber (BP), the refrigerant may be prevented from leaking from a gap between the first scroll 130 and the second scroll 140.

If a pressure of the discharge opening becomes higher than a pressure of the discharge space (D), the discharge check valve 108 may move upward so that the refrigerant is discharged to the space defined by the stepped portion 158*e*. Then, the refrigerant may be introduced into the one or more intermediate discharge opening(s) 158*d*, and may then be discharged to the discharge space (D). If the scroll compressor 100 is stopped or pressure of the discharge space (D) temporarily increases, the discharge check valve 108 may move downward to block the discharge opening 145. This may prevent counter rotation of the second scroll 140 occurring due to backflow of the refrigerant.

During a defrosting operation, or when a driving mode is converted into a heating or cooling mode, pressure of the suction space (S) may be temporarily higher than pressure of the discharge space (D). If the scroll compressor operates in such a state, the pressure of the refrigerant introduced to the back pressure chamber (BP) via the intermediate pressure discharge opening 147 may be much higher than the pressure of the suction space (S), which may be much higher than a pressure of the discharge space (D). By the excessive pressure, the second scroll 140 may be pressed excessively toward the first scroll 130. This may cause an increase in friction between the first scroll 130 and the second scroll 140, thus generating noise and vibration and increasing a driving force.

The pressure of the suction space may be maintained to be higher than the pressure of the discharge space during the defrosting operation or when the driving mode is converted into the heating or cooling mode. If the system is in a steady state after a lapse of time, the pressure of the suction space may become lower than the pressure of the discharge space. In this state, the pressure inside the back pressure chamber may be also lowered to have a value between the pressure of the suction space and the pressure of the discharge space.

Therefore, the pressure inside the back pressure chamber may be maintained at a proper level until the system reaches the steady state after the defrosting operation, or the mode conversion into the heating or cooling mode.

In such a transition state, pressure of an upper surface of the valve body 124*c* or the back pressure discharge opening 152*a* may be higher than the pressure inside the path forming portion 149*a*. Accordingly, the valve body 124*c* may move downward to open the back pressure discharge opening 152*a*. As a result, the refrigerant may be discharged to the discharge space (D) via the path forming portion 149*a* and the discharge path, and the pressure inside the back pressure chamber may be lowered. As the pressure inside the back pressure chamber is lowered, friction between the first scroll 130 and the second scroll 140 may be reduced.

The refrigerant inside the back pressure chamber may be discharged with a lower speed than in the conventional case using the lip seal as an area of the back pressure discharge opening 152*a* is much smaller than a volume of the back pressure chamber. In a case of using the lip seal, a refrigerant may be discharged to the discharge space through an entire surface on a circumference of the lip seal. This may cause the pressure of the back pressure chamber of the conventional scroll compressor to be drastically lowered. As the lowered pressure cannot resist the pressure of the suction space, which has increased during the transition state, the floating plate may move downward and the second scroll 140 may be maintained at an elevated state.

On the other hand, in this embodiment, the increased pressure inside the back pressure chamber may be gradually lowered. This may allow a sufficient back pressure to be transferred to the second scroll 140 during the transition state. As the pressure inside the back pressure chamber gradually increases or decreases even if the operating condition drastically changes, the effect on the scroll compressor due to the drastic change in the operating condition may be reduced.

Further, as the check valve may be implemented with a reed valve, the structure of the scroll compressor may be simplified and installation costs may be reduced. Further, even if the specification of the scroll compressor changes, the check valve may be readily used in a scroll compressor in the different specification.

The shape of the check valve may not be limited to the illustrated example, but may be realized in various shapes.

Figure 10:
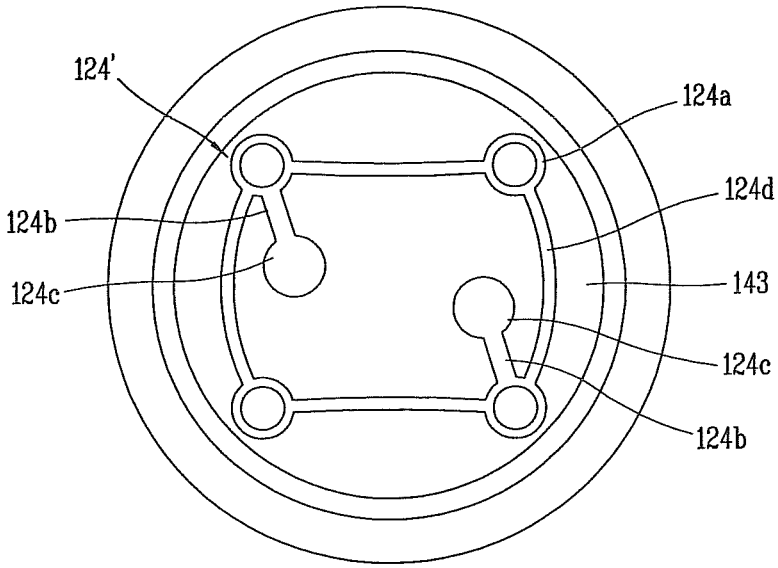
FIG. 10 is a perspective view of a check valve according to an embodiment.

FIG. 10 illustrates a check valve according to another embodiment. In FIG. 10, the check valve may be applied to a case in which the second scroll 140 includes two back pressure discharge openings. If two or more back pressure discharge openings are formed at the plate portion of the second scroll 140, a check valve 124, 124' may be installed at each of the back pressure discharge openings. However, as shown in FIG. 10, the check valves may be connected to an edge portion 124*d* of a near rectangular shape.

In this case, the valve supporting portions 124*a* may be formed in correspondence to a plurality of bolt coupling holes of the plate portion of the second scroll 140, and two connection portions 124*b* may be connected to some of the valve supporting portions 124*a*. With such a configuration, a plurality of valves need not be individually installed, and thus installation of the valves may be facilitated.

Figure 11:
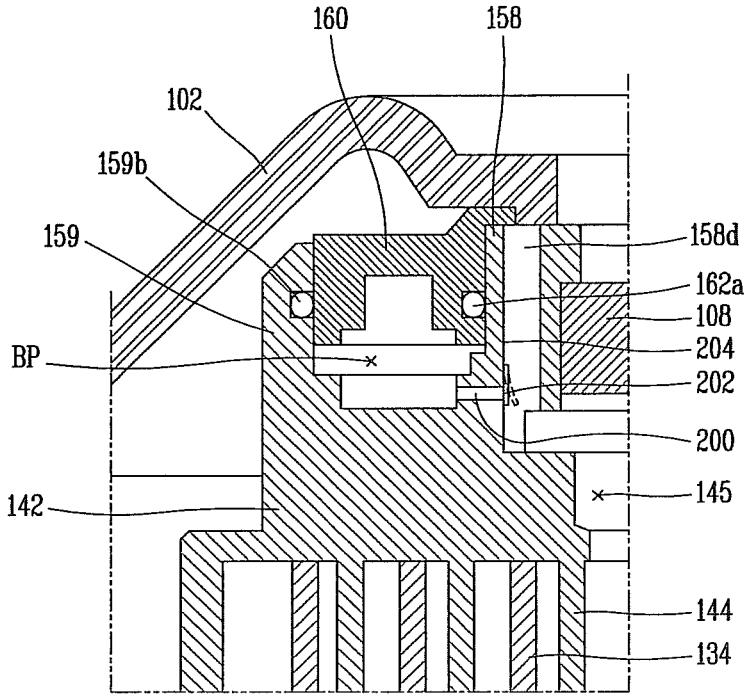
FIG. 11 is a sectional view showing a scroll compressor having a back pressure discharge according to another embodiment of the present disclosure.

The back pressure chamber assembly and the second scroll 140 may be integrally formed with each other. Referring to FIG. 11, the first and second ring-shaped walls 158 and 159 may be integrally formed on an upper surface of the plate portion of the second scroll 140, and the floating plate 160 may be interposed between the first and second ring-shaped walls 158 and 159 together with the O-rings 159*b* and 162*a*. As a result, the refrigerant inside the back pressure chamber (BP) may be prevented from being discharged between the floating plate 160 and the first or second ring-shaped walls 158 and 159.

A back pressure discharge path 200 to communicate the inside of the back pressure chamber with the discharge path may be penetratingly-formed or in the first ring-shaped wall 158. The back pressure discharge path 200 may play the same role as the back pressure discharge opening 152*a* and the path forming portion 149*a*. That is, when pressure inside the back pressure chamber is higher than pressure inside the discharge path, the refrigerant inside the back pressure chamber may be discharged to the back pressure discharge path 200 by a check valve 202 provided in the back pressure discharge path. A valve seat portion 204 to mount the check valve 202 may be formed on an inner surface of the discharge path. The valve seat portion 204 may have a planar surface, so that the check valve in a plate shape may be mounted thereon.

Embodiments disclosed herein provide a scroll compressor having a back pressure discharge.

Embodiments disclosed herein provide a scroll compressor that may include a casing; a discharge cover fastened to the casing from within, the discharge cover dividing an inner surface of the casing into a suction space a discharge space; a main frame fastened to the casing from within and the main frame formed spaced apart from the discharge cover; a first or orbital scroll supported by the main frame, the orbital scroll being configured to perform an orbital motion with respect to a rotational shaft of the orbital scroll in operation; a second or fixed scroll forming a suction chamber, an intermediate pressure chamber, and a discharge chamber together with the orbital scroll, the fixed scroll being formed to be movable with respect to the orbital scroll and the fixed scroll comprising a discharge opening through which an operation fluid may be discharged; a back pressure chamber assembly fastened to the fixed scroll with a fastening means or fastener, the back pressure chamber assembly comprising a back pressure chamber to press the fixed scroll toward the orbital scroll by receiving a portion of the operation fluid from the intermediate pressure chamber, a back pressure discharge opening that communicates with the back pressure chamber, and a discharge path that communicates the discharge chamber and the discharge space with each other, where a back pressure discharge path to communicate the back pressure discharge opening and the discharge path with each other may be formed between the back pressure chamber assembly and the fixed scroll; and a check valve to prevent the operation fluid from being introduced into the back pressure chamber and the check valve may be disposed at the back pressure discharge opening.

Embodiments disclosed herein further provide a scroll compressor that may include a casing; a discharge cover fastened to the casing from within and the discharge cover dividing an inner surface of the casing into a suction space and a discharge space; a main frame fastened to the casing from within and the main frame formed spaced apart from the discharge cover; a first or orbital scroll supported by the main frame, the orbital scroll being configured to perform an orbital motion with respect to a rotational shaft of the orbital scroll in operation; a second or fixed scroll forming a suction chamber, an intermediate pressure chamber, and a discharge chamber together with the orbital scroll, the fixed scroll formed to be movable with respect to the orbital scroll and the fixed scroll comprising a discharge opening through which an operation fluid may be discharged; a back pressure chamber assembly fastened to the fixed scroll with a fastening means or fastener, the back pressure chamber assembly comprising a back pressure chamber to press the fixed scroll toward the orbital scroll by receiving a portion of the operation fluid from the intermediate pressure chamber, a back pressure discharge opening that communicates with the back pressure chamber, and a discharge path to communicate the discharge chamber and the discharge space with each other, where a back pressure discharge path to communicate the back pressure discharge opening and the discharge path with each other may be formed between the back pressure chamber assembly and the fixed scroll; and a check valve to prevent the operation fluid from being introduced into the back pressure chamber and the check valve disposed at the back pressure discharge opening.

The fixed scroll and the back pressure chamber assembly may be separately formed to be coupled to each other or fastened using a fastening means or fastener. The back pressure discharge path and the check valve to discharge an operation fluid to the discharge path when the pressure inside the back pressure chamber is higher than the discharge pressure, may be provided between the fixed scroll and the back pressure chamber assembly. With such a configuration, even if the operating condition changes, the pressure inside the back pressure chamber may be maintained to be equal to or lower than the discharge pressure. Further, as the discharge path may be designed to discharge the operation fluid via the discharge path slower through the back pressure discharge opening than through the conventional lip seal, it may take a predetermined time for the pressure inside the back pressure chamber to become equal to the pressure of the discharge chamber. Accordingly, even if there is a temporary change in the operating condition of the scroll compressor, the pressure inside the back pressure chamber may be prevented from drastically decreasing or increasing until the scroll compressor returns to its normal operating condition.

The suction chamber, the intermediate pressure chamber, and the discharge chamber are some of a plurality of compression chambers formed by the orbital scroll and the fixed scroll. More specifically, the suction chamber may refer to a compression chamber where a refrigerant has been sucked to start a compression operation. The discharge chamber, which may communicate with a discharge opening, may refer to a compression chamber where a discharge has just begun or is in the process. The intermediate pressure chamber, which may be disposed between the suction chamber and the discharge chamber, may refer to a compression chamber where a compression operation is being processed.

The back pressure discharge opening may be provided in plurality. In a case in which a plurality of discharge openings are formed, the refrigerant may be discharged with a higher speed and a higher pressure than in a case where a single discharge opening is formed. The plurality of discharge openings may be disposed at a periphery of the discharge path, so that the refrigerant inside the back pressure chamber may be discharged more uniformly.

The back pressure discharge path may be defined by a groove portion concaved from an upper surface of the fixed scroll and a lower surface of the back pressure chamber assembly. The check valve may be configured to open and close the back pressure discharge opening while moving in the groove portion. As the back pressure discharge path is formed on an upper surface of the fixed scroll, the back pressure discharge path of any shape may be easily processed. Alternatively, the back pressure discharge path may be defined by a groove portion concaved from a lower surface of the back pressure chamber assembly.

The movement of the check valve may be restricted by an inner surface of the groove portion. Alternatively, the movement of the check valve may be restricted by a retainer provided in the groove portion. As the check valve, a plate type valve called 'reed valve' may be used.

The groove portion may include a valve space portion to provide a moving space for the check valve and a path forming portion that extends up to a lower portion of the discharge path, such that the discharged operation fluid may be transferred to the discharge path.

The check valve may include a valve body configured to cover the back pressure discharge opening and a valve supporting portion or support configured to fix the valve body between the fixed scroll and the back pressure chamber assembly. The valve supporting portion may be formed to enclose the discharge opening, and the valve body may extend inward from the valve supporting portion in a radial direction.

The back pressure chamber assembly may include a back pressure plate fixed to the fixed scroll below the discharge cover, the back pressure plate enclosing a space portion of which its upper part is open, where the space portion communicates with the intermediate pressure chamber. The back pressure chamber assembly may also include a floating plate movably coupled to the back pressure plate so as to seal the space portion, and the floating plate may form a back pressure chamber together with the back pressure plate.

The back pressure plate may include a supporting plate of a ring shape, which may contact an upper surface of the fixed scroll, a first ring-shaped wall formed to enclose an inner space portion of the supporting plate, and a second ring-shaped wall disposed on or at an outer circumferential portion of the first ring-shaped wall.

The floating plate may be of a ring shape. The floating plate and the back pressure plate may be coupled to each other, such that an outer circumferential surface of the first ring-shaped wall contacts an inner circumferential surface of the floating plate and an inner circumferential surface of the second ring-shaped wall contacts an outer circumferential surface of the floating plate. O-rings may be interposed between the floating plate and the first ring-shaped wall and between the floating plate and the second ring-shaped wall.

The second ring-shaped wall may be positioned on or at an outer circumferential surface of the supporting plate. That is, the back pressure plate may have a sectional surface of a 'U'-shape.

The second ring-shaped wall may be inwardly spaced apart from an outer circumferential surface of the supporting plate. That is, a flange may be formed outside the second ring-shaped wall. A plurality of bolt coupling holes may be formed on the supporting plate, outside the second ring-shaped wall in a radial direction, and the fixed scroll and the back pressure plate may be coupled to each other by bolts inserted into the bolt coupling holes.

A sealing means or seal may be installed at a contact surface between the back pressure plate and the fixed scroll. With such a configuration, a discharged refrigerant may be prevented from leaking between the back pressure plate and the fixed scroll.

The fixed scroll may include an intermediate pressure discharge opening that communicates with the intermediate pressure chamber, and the back pressure plate may include an intermediate pressure suction opening that communicates with the intermediate pressure discharge opening. With such a configuration, an intermediate pressure may be applied into the back pressure chamber. A sealing means or seal may be provided so as to prevent leakage of a refrigerant between the intermediate pressure discharge opening and the intermediate pressure suction opening.

Embodiments disclosed herein provide a scroll compressor, that may include a casing having a suction space and a discharge space; a fixed scroll forming a suction chamber, an intermediate pressure chamber, and a discharge chamber together with the orbital scroll; a back pressure forming member including a back pressure chamber to press the fixed scroll toward the orbital scroll by receiving an operation fluid from the intermediate pressure chamber, the back pressure forming member being fastened to the fixed scroll using a fastening means or fastener; and a check valve configured to discharge an operation fluid inside the back pressure chamber to the discharge space when pressure inside the back pressure chamber is higher than pressure of the discharge space through a back pressure discharge path formed between the back pressure chamber and the discharge space, where the back pressure discharge path is formed between the fixed scroll and the back pressure forming member.

The back pressure forming member may include a floating member configured to change a volume of the back pressure chamber according to the pressure inside the back pressure chamber and a back pressure plate having a space portion which forms the back pressure chamber together with the floating member. A sealing means or seal to prevent leakage of an operation fluid may be disposed between facing surfaces of the floating member and the back pressure plate.

Embodiments disclosed herein provide a scroll compressor that may include a casing; a discharge cover fastened to the casing from within, the discharge cover dividing an inner space of the casing into a suction space and a discharge space; a main frame fastened to the casing from within, the main frame formed spaced apart from the discharge cover; a first or orbital scroll supported by the main frame, the orbital scroll performing an orbital motion with respect to a rotational shaft of the orbital scroll in operation; a second or fixed scroll comprising a fixed wrap to form a suction chamber, an intermediate pressure chamber, and a discharge chamber together with the orbital scroll, the fixed scroll formed to be movable with respect to the orbital scroll, and the fixed scroll including a first ring-shaped wall and a second ring-shaped wall to form a back pressure chamber, to which part of an operation fluid inside the intermediate pressure chamber is received; a floating plate installed between the first ring-shaped wall and the second ring-shaped wall, the floating plate being configured to seal the back pressure chamber, wherein a discharge path to introduce an operation fluid discharged from the discharge chamber to the discharge space may be formed in the first ring-shaped wall, and wherein a back pressure discharge path to penetrate a portion of the fixed scroll may be formed to have the back pressure chamber communicate with the discharge path; and a check valve installed on the discharge path, the check valve preventing the operation fluid from being introduced into the back pressure chamber from the discharge path.

The back pressure chamber may be integrally formed at the fixed scroll, such that discharge of the operation fluid may be prevented between the floating plate and the fixed scroll, and the back pressure discharge path may be installed in the fixed scroll. The back pressure discharge path may be penetratingly-formed at the first ring-shaped wall. A valve seat portion configured to support the check valve may be formed on an inner surface of the discharge path.

Embodiments disclosed herein may have at least the following advantages.

Due to the check valve that discharges an operation fluid to the discharge path when the pressure inside the back pressure chamber is higher than the discharge pressure, even if the operating condition of the scroll compressor changes, the pressure inside the back pressure chamber may be maintained to be equal to or lower than the discharge pressure. This may prevent the fixed scroll from excessively pressing the orbital scroll when the pressure inside the back pressure chamber drastically increases during the initial operation or resumption of the temporally paused operation of the scroll compressor.

Further, as the operation fluid discharged to the discharge path is discharged slower through the back pressure discharge opening than through the conventional lip seal, it may take a predetermined time for the pressure inside the back pressure chamber to become equal to the pressure of the discharge chamber. Accordingly, even if the operating condition changes temporarily, the pressure inside the back pressure chamber may be maintained within a proper range until the scroll compressor recovers to its normalcy.

The foregoing embodiments and advantages are merely exemplary and are not to be considered as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be considered broadly within its scope as defined in the appended claims, and therefore all changes and modifications that fall within the metes and bounds of the claims, or equivalents of such metes and bounds are therefore intended to be embraced by the appended claims.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A scroll compressor, comprising:

a casing;

a discharge cover, the discharge cover dividing an inner surface of the casing into a suction space and a discharge space;

a main frame, the main frame being formed spaced apart from the discharge cover;

a first scroll supported by the main frame, the first scroll being configured to perform an orbital motion with respect to a rotational shaft thereof in operation;

a second scroll that forms a suction chamber, an intermediate pressure chamber, and a discharge chamber together with the first scroll, the second scroll being movable with respect to the first scroll and the second scroll comprising a discharge opening through which an operation fluid is discharged;

a back pressure chamber assembly coupled to the second scroll, the back pressure chamber assembly comprising a back pressure plate having a back pressure chamber and a floating plate movably disposed in the back pressure chamber, the back pressure chamber assembly being configured to press the second scroll toward the first scroll, the back pressure chamber assembly further comprising a back pressure discharge opening that communicates with the back pressure chamber;

a discharge path by which the discharge chamber and the discharge space communicate with each other, wherein a back pressure discharge path by which the back pressure discharge opening and the discharge path communicate with each other is formed between facing surfaces of the back pressure chamber assembly and the second scroll; and a check valve that prevents the operation fluid from being introduced into the back pressure chamber, the check valve being disposed at the back pressure discharge opening.

2. The scroll compressor of claim 1, further comprising at least one additional back pressure discharge opening.

3. The scroll compressor of claim 1, wherein the back pressure plate includes a groove formed therein to form the back pressure chamber, and wherein the floating plate is movably disposed in the groove.

4. The scroll compressor of claim 3, wherein a lower surface of the back pressure plate faces an upper surface of the second scroll.

5. The scroll compressor of claim 3, wherein the back pressure discharge path is formed between the lower surface of the back pressure plate and the upper surface of the second scroll and extends in a lateral direction.

6. The scroll compressor of claim 3, wherein the valve body comprises a plurality of connected valve bodies corresponding to a number of back pressure discharge openings.

7. The scroll compressor of claim 6, wherein the movement of the check valve is restricted by an inner surface of the groove.

8. The scroll compressor of claim 6, wherein the movement of the check valve is restricted by a retainer provided in the groove.

9. The scroll compressor of claim 1, wherein the check valve is open and closed by a pressure difference between the back pressure chamber and the discharge space.

10. The scroll compressor of claim 1, wherein the back pressure discharge path is defined by a groove concaved from a lower surface of the back pressure chamber assembly, and an upper surface of the second scroll, and wherein the check valve is configured to open and close the back pressure discharge hole opening via a movement within the groove.

11. The scroll compressor of claim 10, wherein the movement of the check valve is restricted by an inner surface of the groove.

12. The scroll compressor of claim 1, wherein the back pressure discharge path is defined by a groove concaved from an upper surface of the second scroll and a lower surface of the back pressure chamber assembly, and wherein the check valve is configured to open and close the back pressure discharge opening via a movement within the groove.

13. The scroll compressor of claim 12, wherein the movement of the check valve is restricted by an inner surface of the groove.

14. The scroll compressor of claim 1, wherein the back pressure discharge path includes a groove formed in one of a lower surface of the back pressure plate or an upper surface of the second scroll, and wherein the groove comprises:

a valve space to provide a moving space for the check valve; and a path extending up to the discharge path, such that the operation fluid discharged from the back pressure chamber is transferred to the discharge path.

15. The scroll compressor of claim 1, wherein the check valve comprises:

a valve body configured to cover the back pressure discharge opening; and a valve support configured to fix the valve body between the second scroll and the back pressure chamber assembly.

16. The scroll compressor of claim 15, wherein the valve body comprises a plurality of connected valve bodies corresponding to a number of back pressure discharge openings.

17. The scroll compressor of claim 15, wherein the valve support is formed to enclose the back pressure discharge opening, and the valve body extends inward from the valve support in a radial direction.

18. The scroll compressor of claim 1, wherein the back pressure chamber assembly comprises:

the back pressure plate fastened to the second scroll below the discharge cover, the back pressure plate comprising the back pressure chamber with which the intermediate pressure chamber communicates; and the floating plate movably coupled to the back pressure plate so as to seal an upper portion of the back pressure chamber.

19. The scroll compressor of claim 18, wherein the back pressure plate comprises:

a supporting plate having a ring shape that contacts an upper surface of the second scroll;

a first ring-shaped wall formed to enclose an inner space; and a second ring-shaped wall disposed at an outer circumference of the first ring-shaped wall.

20. The scroll compressor of claim 19, wherein the floating plate is ring-shaped, and wherein the floating plate and the back pressure plate are coupled such that an outer circumferential surface of the first ring-shaped wall contacts an inner circumferential surface of the floating plate and an inner circumferential surface of the second ring-shaped wall contacts an outer circumferential surface of the floating plate.

21. The scroll compressor of claim 20, further comprising seal interposed between the floating plate and each of the first ring-shaped wall and the second ring-shaped wall.

22. The scroll compressor of claim 19, further comprising a plurality of bolt coupling holes formed on the supporting plate, wherein the second scroll and the back pressure plate are fastened by a corresponding number of bolts, which pass through the plurality of bolt coupling holes.

23. The scroll compressor of claim 18, further comprising a seal provided at a contact surface between the back pressure plate and the second scroll.

24. A scroll compressor, comprising:

a casing comprising a suction space and a discharge space;

a first scroll, and a second scroll that forms a suction chamber, an intermediate pressure chamber, and a discharge chamber together with the first scroll;

a back pressure chamber assembly comprising a back pressure plate and a floating plate that together form a back pressure chamber, the back pressure chamber assembly pressing the second scroll toward the first scroll; and a check valve configured to discharge an operation fluid inside the back pressure chamber to the discharge space when a pressure inside the back pressure chamber is higher than a pressure of the discharge space through a back pressure discharge path formed between facing surfaces of the back pressure chamber assembly and the second scroll.

25. The scroll compressor of claim 24, further comprising at least one back pressure discharge opening through which the operation fluid is discharged from the back pressure chamber.

26. The scroll compressor of claim 24, wherein the back pressure plate includes a groove formed therein to form the back pressure chamber and the floating plate is movably disposed in the groove.

27. The scroll compressor of claim 26, wherein a lower surface of the back pressure plate faces an upper surface of the second scroll.

28. The scroll compressor of claim 27, wherein the back pressure discharge path is formed between the lower surface of the back pressure plate and the upper surface of the second scroll and extends in a lateral direction.

29. The scroll compressor of claim 24, wherein the back pressure discharge path includes a groove formed in one of a lower surface of the back pressure plate or an upper surface of the second scroll.

30. The scroll compressor of claim 29, wherein the movement of the check valve is restricted by an inner surface of the groove.

31. The scroll compressor of claim 29, wherein the movement of the check valve is restricted by a retainer provided in the groove.

32. The scroll compressor of claim 24, wherein the check valve is open and closed by a pressure difference between the back pressure chamber and the discharge space.

33. The scroll compressor of claim 24, wherein the back pressure discharge path is defined by a groove concaved from a lower surface of the back pressure chamber assembly, and an upper surface of the second scroll, and wherein the check valve is configured to open and close a back pressure discharge hole via a movement within the groove.

34. The scroll compressor of claim 33, wherein the movement of the check valve is restricted by an inner surface of the groove.

35. The scroll compressor of claim 24, wherein the back pressure discharge path is defined by a groove concaved from an upper surface of the second scroll and a lower surface of the back pressure chamber assembly, and wherein the check valve is configured to open and close a back pressure discharge opening via a movement within the groove.

36. The scroll compressor of claim 35, wherein the movement of the check valve is restricted by an inner surface of the groove.

37. The scroll compressor of claim 24, wherein the back pressure discharge path includes a groove formed in one of a lower surface of the back pressure plate or an upper surface of the second scroll, and wherein the groove comprises:

a valve space to provide a moving space for the check valve; and a path extending to a discharge path, such that the operation fluid discharged from the back pressure chamber is transferred to the discharge path.

38. The scroll compressor of claim 24, wherein the check valve comprises:

a valve body configured to cover a back pressure discharge opening formed in the back pressure plate; and a valve support configured to fix the valve body between the second scroll and the back pressure chamber assembly.

39. The scroll compressor of claim 38, wherein the valve body comprises a plurality of connected valve bodies corresponding to a number of back pressure discharge openings.

40. The scroll compressor of claim 38, wherein the valve support is formed to enclose the back pressure discharge opening, and the valve body extends inward from the valve support in a radial direction.

41. The scroll compressor of claim 24, wherein the back pressure chamber assembly comprises:

the back pressure plate fastened to the second scroll, the back pressure plate comprising the back pressure chamber with which the intermediate pressure chamber communicates; and the floating plate movably coupled to the back pressure plate so as to seal an upper portion of the back pressure chamber.

42. The scroll compressor of claim 41, wherein the back pressure plate comprises:

a supporting plate having a ring shape that contacts an upper surface of the second scroll;

a first ring-shaped wall formed to enclose an inner space; and a second ring-shaped wall disposed at an outer circumference of the first ring-shaped wall.

43. The scroll compressor of claim 42, wherein the floating plate is ring-shaped, and wherein the floating plate and the back pressure plate are coupled such that an outer circumferential surface of the first ring-shaped wall contacts an inner circumferential surface of the floating plate and an inner circumferential surface of the second ring-shaped wall contacts an outer circumferential surface of the floating plate.

44. The scroll compressor of claim 43, further comprising a seal interposed between the floating plate and each of the first ring-shaped wall and the second ring-shaped wall.

45. The scroll compressor of claim 42, further comprising a plurality of bolt coupling holes formed on the supporting plate, wherein the second scroll and the back pressure plate are fastened by a corresponding number of bolts, which pass through the plurality of bolt coupling holes.

46. The scroll compressor of claim 41, further comprising a seal provided at a contact surface between the back pressure plate and the second scroll.

47. A scroll compressor, comprising:

a casing;

a discharge cover, the discharge cover dividing an inner space of the casing into a suction space and a discharge space;

a main frame, the main frame being spaced apart from the discharge cover;

a first scroll having a first wrap and supported by the main frame, the first scroll being configured to perform an orbital motion with respect to a rotational shaft in operation;

a second scroll comprising a second wrap that forms a suction chamber, an intermediate pressure chamber, and a discharge chamber together with the first scroll, the second scroll being movable with respect to the first scroll, and the second scroll comprising a first ring-shaped wall and a second ring-shaped wall that form a back pressure chamber into which a portion of an operation fluid inside the intermediate pressure chamber is received;

a floating plate installed between the first ring-shaped wall and the second ring-shaped wall, the floating plate sealing the back pressure chamber, wherein a discharge path to introduce the operation fluid discharged from the discharge chamber to the discharge space is formed in the first ring-shaped wall, and wherein a back pressure discharge path penetrates a portion of the second scroll, the back pressure chamber and the discharge path communicating via the back pressure discharge path; and a check valve installed on the discharge path, the check valve being configured to prevent the operation fluid from being introduced into the back pressure chamber from the discharge path.

48. The scroll compressor of claim 47, further comprising a valve seat that supports the check valve, wherein the valve seat is formed on an inner surface of the discharge path.

49. The scroll compressor of claim 47, wherein the check valve is open and closed by a pressure difference between the back pressure chamber and the discharge space.

* * * * *